US008967730B2

(12) United States Patent
Antoine et al.

(10) Patent No.: US 8,967,730 B2
(45) Date of Patent: Mar. 3, 2015

(54) WETHEAD SEAL DESIGN FOR CONTINUOUS MINING MACHINE

(71) Applicant: Caterpillar Global Mining America, LLC, Houston, PA (US)

(72) Inventors: Darren Brent Antoine, East Peoria, IL (US); Todd William Wampler, Elizabeth, PA (US); Roger Lee O'Quinn, Blacksburg, VA (US); Estel Owens, Washington, PA (US); Steven Murray Shaffer, Sparland, IL (US)

(73) Assignee: Caterpillar Global Mining America LLC, Houston, PA (US)

( * ) Notice: Subject to any disclaimer, the term of this patent is extended or adjusted under 35 U.S.C. 154(b) by 56 days.

(21) Appl. No.: 13/932,273

(22) Filed: Jul. 1, 2013

(65) Prior Publication Data

US 2015/0001912 A1 Jan. 1, 2015

(51) Int. Cl.

| | |
|---|---|
| ***E21C 35/22*** | (2006.01) |
| ***E21B 21/00*** | (2006.01) |
| ***E21C 25/00*** | (2006.01) |

(52) U.S. Cl.

CPC .. *E21C 7/08* (2013.01); *E21C 25/00* (2013.01)
USPC ..... 299/81.3; 299/12; 299/81.1; 299/81.2

(58) Field of Classification Search

CPC ..... E21C 35/23; E21C 27/24; E21C 7/08
USPC ..... 299/12, 81.1–81.3
See application file for complete search history.

(56) References Cited

U.S. PATENT DOCUMENTS

| | | | |
|---|---|---|---|
| 3,698,769 | A | 10/1972 | Amoroso |
| 4,289,357 | A | 9/1981 | Hintermann et al. |
| 5,507,565 | A | 4/1996 | LeBegue et al. |
| 6,070,944 | A | 6/2000 | LeBegue |
| 6,139,112 | A | 10/2000 | Parrott |
| 8,235,470 | B2 | 8/2012 | Zimmerman et al. |

*Primary Examiner* — John Kreck
*Assistant Examiner* — Carib Oquendo
(74) *Attorney, Agent, or Firm* — Finnegan, Henderson, Farabow, Garrett & Dunner, LLP

(57) ABSTRACT

A continuous mining machine may include a stationary boom member, a stationary gear and bearing housing attached to the boom member, and a cutter drum assembly rotatably mounted on the stationary gear and bearing housing. Cutting elements and spray nozzles may be mounted on the rotatable cutter drum assembly. The spray nozzles may be configured to direct liquid spray at a mine face as mine material is dislodged by rotation of the cutter drum assembly and contact of the cutting elements with the mine face. Stationary liquid passageways may be provided through the gear and bearing housing, and rotatable liquid passageways may be provided through the rotatable cutter drum assembly and configured to convey liquid to the spray nozzles. A liquid distribution cavity may be defined within the cutter drum assembly between two labyrinth-type, non-contacting seal assemblies, the liquid distribution cavity configured to convey liquid from the stationary liquid passageways to the rotatable liquid passageways and to the spray nozzles.

20 Claims, 8 Drawing Sheets

WETHEAD SEAL DESIGN FOR CONTINUOUS MINING MACHINE

TECHNICAL FIELD

The present disclosure relates generally to continuous mining and, more particularly, to a wethead seal design for a continuous mining machine.

BACKGROUND

In underground mining operations using drum-type continuous miners, water spray nozzles may be located on the cutting drum near each cutter bit to suppress the generation of airborne dust and frictional ignition as the cutter bits engage the mine face. Airborne dust and wet dislodged material may also be suppressed by mounting spray nozzles on a bar located behind the cutter drum. The bar mounted spray nozzles wet the mine material above and below the cutter drum and also wet the bits as the cutter drum completes each rotation.

The effectiveness of a spray bar is limited and may not control dust before it becomes airborne. However, the incorporation of spray nozzles located immediately adjacent the cutter bits on the surface of the cutter drum has been found to be effective in suppressing dust before it becomes airborne. The water is continuously sprayed from the cutter bits directly at the point where the material is dislodged from the mine face. Generating a water spray at the cutter bits suppresses the dust at its source and effectively eliminates any risk of frictional ignition as the cutter bits strike the solid material. Generating a water spray from the nozzles also serves to extend the life of cutter bits for continuous miners. Water is supplied to the nozzles on the surface of a continuous miner drum from a water supply on a non-rotating portion of the mining machine. For example, water is supplied from the cooling circuits of the drive motors and conveyed through conduits in stationary struts and housings to a rotary seal mounted concentrically on the axis of the drum. Conventional rotary seals are positive pressure seals designed to prevent any leakage of the water past the seals. A rotary seal has a stationary part with ports for receiving the water and a rotational part mounted on or connected to the drive shaft. In order to maintain a positive pressure seal between the stationary and rotating parts, the rotary seal typically employs an elastomeric material such as rubber, or surfaces of other materials such as carbon that are machined to extremely tight tolerances. Surfaces of the positive pressure rotary seal are in constant contact in order to form the seal. Relative rubbing motion between the parts may cause wear and eventual failure of the seal. A typical positive pressure rotary seal in a mining machine must also keep the water from leaking into contact with the gears and bearings as the water passes through the rotary seal on its way to fittings on spray nozzles associated with the cutter bits.

A critical aspect in supplying water through a cutter drum to the external surface behind the cutter bits is the effectiveness of the rotary seal in preventing leakage of water into the gearcase and bearings. With a positive pressure seal for a continuous mining machine, this problem is aggravated because a relatively large rotating seal must be used around the drive shaft of the continuous miner. The larger diameter rotary seal has more contact surface area where breakdown of the seal or other failures can occur. This problem is further complicated with continuous miners having multiple sections. A typical continuous miner includes a pair of end drum sections and a center drum section. Each section has a separate drive shaft requiring separate large diameter rotary seals. In addition to preventing contamination of the gearcase and bearings, the rotary seal must withstand periods of time in which it runs dry where water is not circulated to the seal.

A continuous mining machine is disclosed in U.S. Pat. No. 5,507,565 that issued to LeBegue et al. on Apr. 16, 1996 ("the '565 patent"). The continuous mining machine in the '565 patent provides a cutter drum assembly rotatably mounted on a boom member. Cutter bits are secured to the cutter drum assembly and extend therefrom. A gearcase is positioned in the cutter drum. A plurality of sprayers are associated with the cutting elements for spraying water onto the material being mined. Positive pressure liquid seals are positioned in the gearcase for directing liquid through the gearcase to the spray devices and preventing liquid from coming into contact with the bearing means. A lubricant seal is required surrounding the positive pressure liquid seals in the gearcase to keep the liquid seals lubricated and to act as a redundant seal to prevent liquid leakage from the liquid seals contaminating the bearings.

Although the apparatus of the '565 patent may have improved the ability to spray liquid onto the mine face as material is dislodged, while avoiding contamination of the gearcase with the liquid, the apparatus may still be problematic. In particular, the apparatus disclosed in the '565 patent requires positive pressure water seals that are subject to constant wear, and that must be relied upon to keep water from getting into the bearings and gear assemblies. Failure of one of these seals can allow water to get into the bearings or gearcase, causing catastrophic failure. The seals are also buried deep inside the assembly, making replacement or maintenance of the seals difficult. Additionally, the seals require lubrication with oil-based lubricants, and additional lubricant seals must be provided to contain the lubricants in contact with the liquid seals.

The continuous mining machine of the present disclosure solves one or more of the problems set forth above and/or other problems in the art.

SUMMARY OF THE INVENTION

In one aspect, the present disclosure is directed to a continuous mining machine that includes a cutter drum assembly rotatably mounted on a stationary gear and bearing housing attached to a boom assembly of the mining machine. Cutting elements may be mounted on the rotatable cutter drum assembly, with spray nozzles located in close proximity to the cutting elements to direct liquid spray at a mine face as mine material is dislodged by rotation of the cutter drum assembly and contact of the cutting elements with the mine face. Stationary liquid passageways may be provided through the gear and bearing housing, and rotatable liquid passageways may be provided through the rotatable cutter drum assembly and configured to convey liquid to the spray nozzles. A liquid distribution cavity may be defined within the cutter drum assembly between two labyrinth-type, non-contacting seal assemblies. The liquid distribution cavity may be configured to convey liquid from the stationary liquid passageways to the rotatable liquid passageways and to the spray nozzles for the cutting elements. The two labyrinth-type, non-contacting seal assemblies may be configured to control at least one of liquid quantity and liquid pressure in the stationary and rotatable liquid passageways by providing a controlled leakage pathway directing a portion of the liquid away from the stationary gear and bearing housing to outside of the continuous mining machine.

In another aspect, the present disclosure is directed to a method of controlling at least one of the quantity and the pressure of liquid supplied from a stationary source on a body portion of a continuous mining machine to rotatable cutting elements mounted on a rotatable cutter drum assembly of the machine. The method may include directing the liquid through a manifold extending along a stationary boom member of the machine, into a liquid reservoir formed in a stationary gear and bearing housing mounted on the boom member of the machine, along stationary liquid passageways formed in the gear and bearing housing, and into a liquid distribution cavity defined between two labyrinth-type, non-contacting seal assemblies. The method may further include providing a controlled amount of liquid leakage through each of the labyrinth-type, non-contacting seal assemblies away from the gear and bearing housing and to the outside of the continuous mining machine.

DETAILED DESCRIPTION

Figure 1:
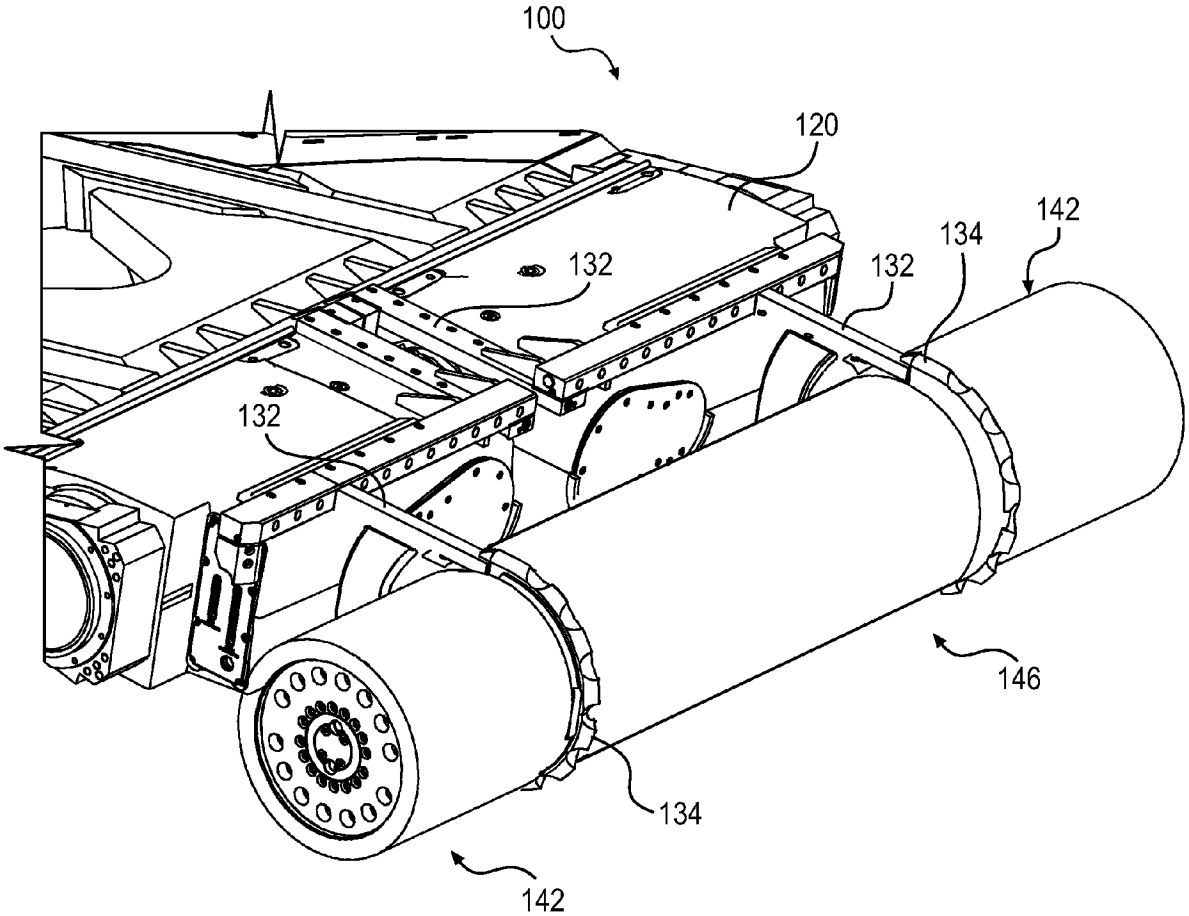
FIG. 1 is a diagrammatic illustration of a continuous mining machine in accordance with an exemplary implementation of this disclosure.
Figure 3:
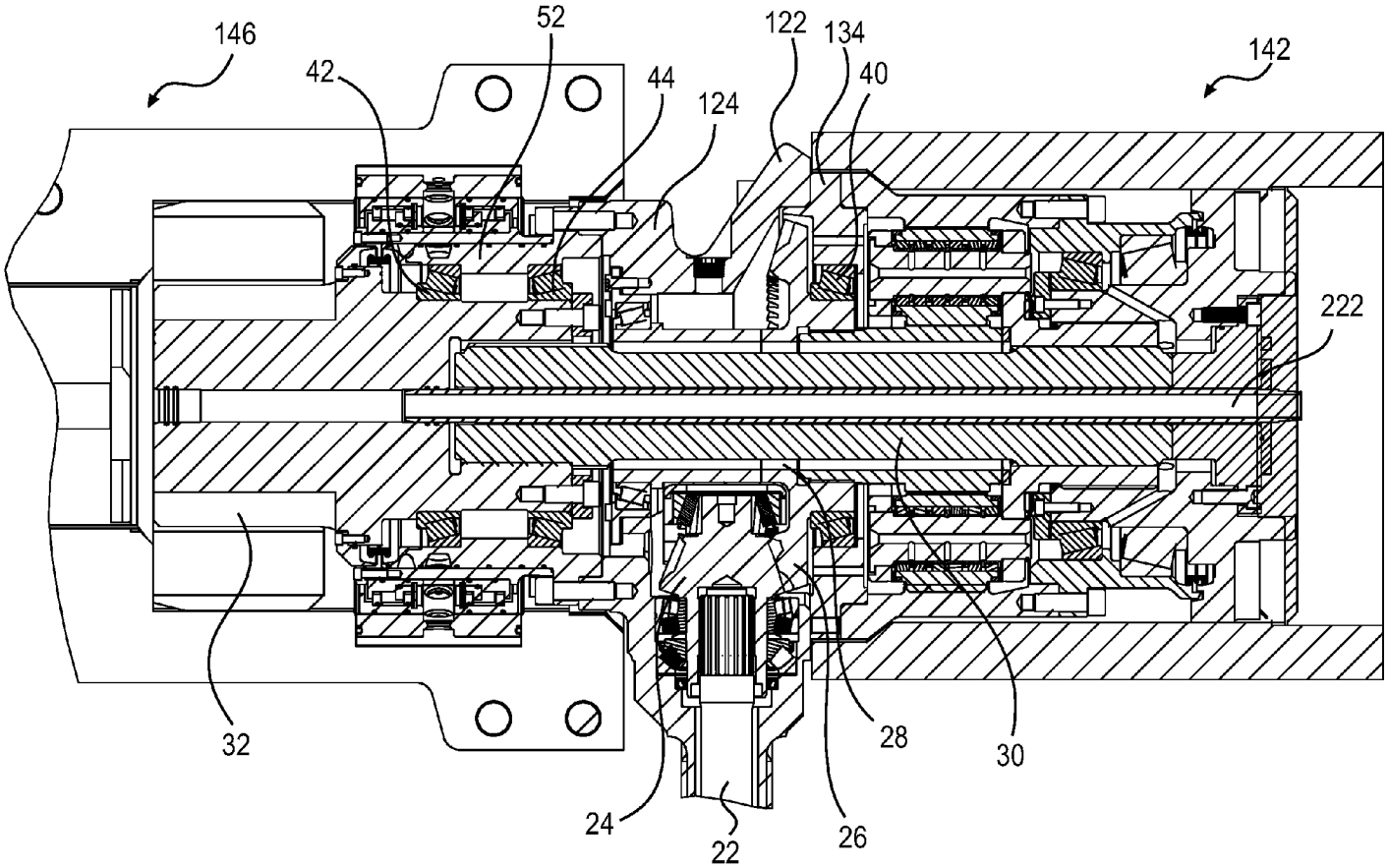
FIG. 3 is a cross-sectional view depicting a portion of the mining machine of FIG. 1.
Figure 7:
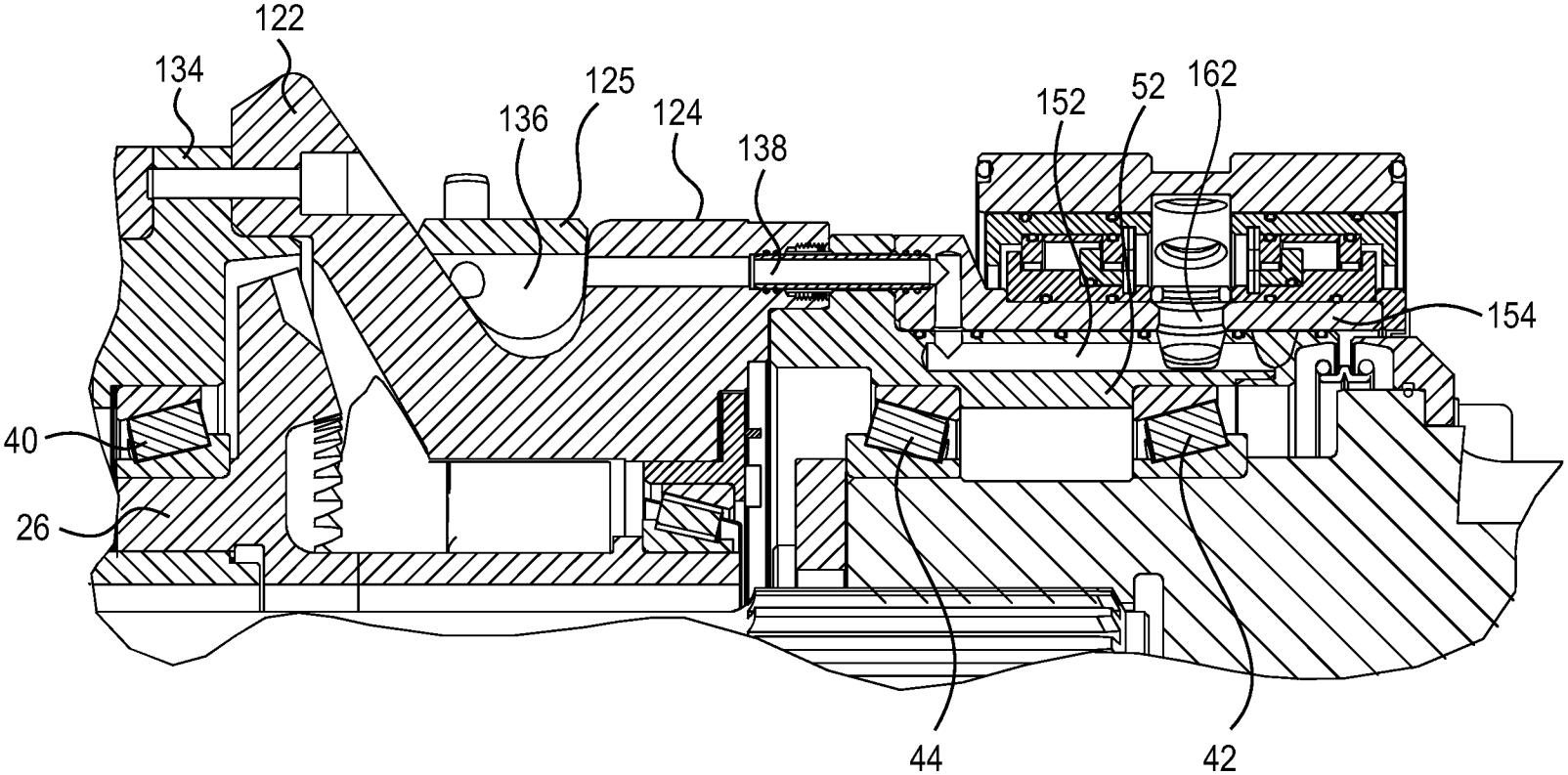
FIG. 7 is a cross-sectional view depicting a portion of the mining machine of FIG. 1.

FIG. 1 illustrates an exemplary mining machine 100 that includes a body portion 120 and boom members 134 extending forwardly from body portion 120. The boom members 134 may be connected to or integral with portions 52, 122, 124 of a gear and bearing housing configured to support gear assemblies and bearing assemblies. FIG. 7 is a cross-sectional view through a portion 122 of the stationary gear and bearing housing, illustrating one of the bolts joining the gear and bearing housing to an end of a boom member 134. FIG. 3 is another cross-sectional view through portions of the stationary gear and bearing housing and through rotating end cutter drum assemblies 142, and rotating center cutter drum assembly 146, illustrating additional bolts joining a first portion 52 of the stationary gear and bearing housing to a second portion 124 of the gear and bearing housing. Rotating cutter drum assemblies 142, 146 may be rotatably mounted on the gear and bearing housing connected to boom members 134. Cutting elements (not shown) may be secured around portions of the outer peripheries of the rotating cutter drum assemblies and extend therefrom. Cutting elements may be provided with hardened tips that contact the mining surface as the continuous mining machine moves the rotating cutter drum assemblies into contact with the mining surface to remove material. Each cutting element may also be provided with one or more liquid spray nozzles that are configured to spray water or other appropriate liquids onto the cutting elements and mining surface to suppress dust at its source and effectively eliminate any risk of frictional ignition as the cutting elements strike the solid material.

Figure 2:
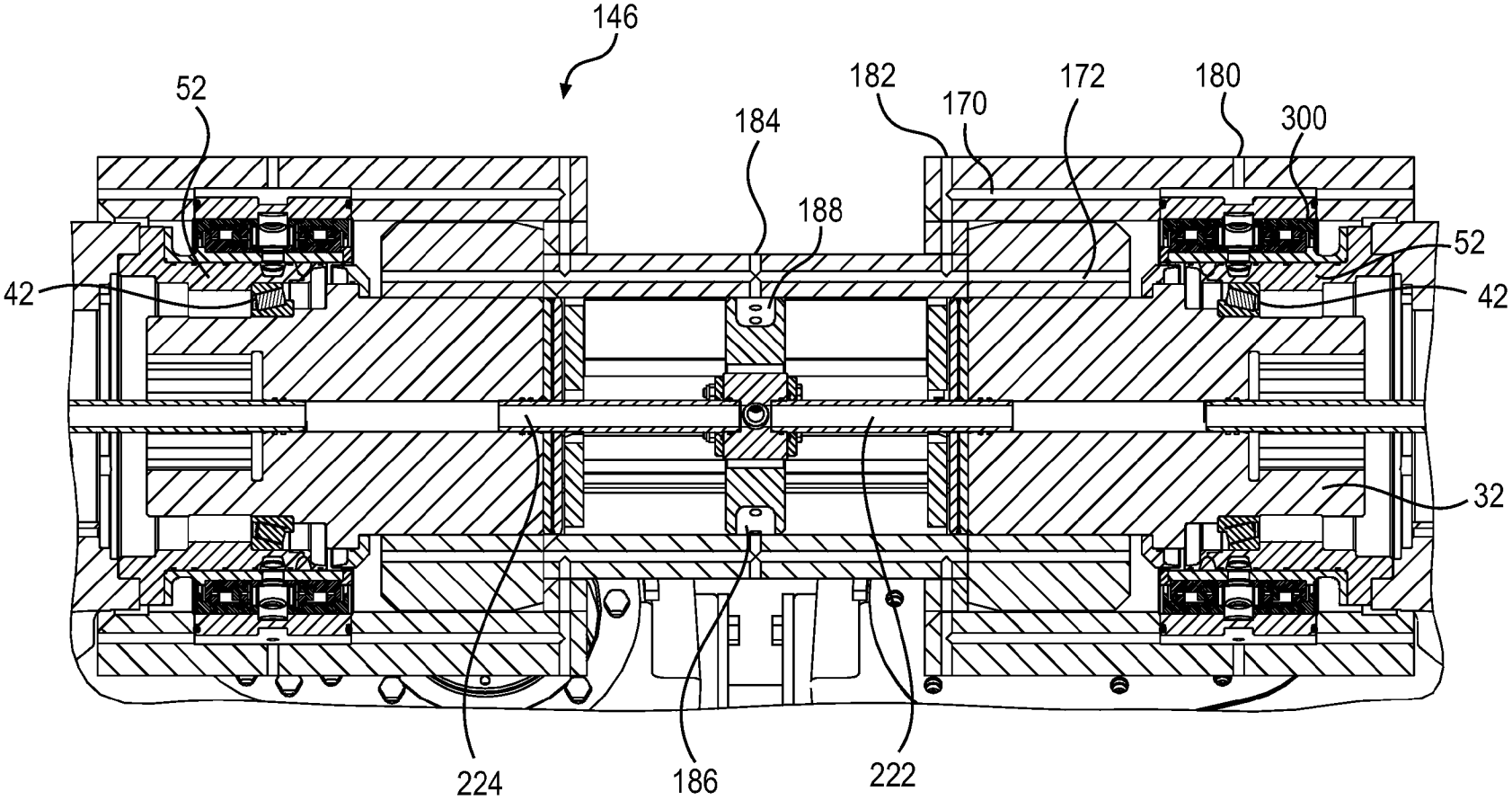
FIG. 2 is a cross-sectional view depicting a portion of the mining machine of FIG. 1.

As shown in FIGS. 2 and 3, bearings 40, 42, 44 in portion 52 of the gear and bearing housing rotatably support drive shafts that are connected to the cutter drum assemblies. One or more power sources may be mounted on body portion 120 of the mining machine for rotating the cutter drum assemblies. Drive shafts 22 and gear assemblies transmit rotation from the power sources to the cutter drum assemblies. In one exemplary implementation illustrated in FIG. 3, drive shaft 22 conveys rotational power from a power source (not shown) on body portion 120 of the continuous mining machine to a pinion gear 24 rotatably mounted in a portion 122 of the gear and bearing housing. Pinion gear 24 engages with a bevel gear 26, which converts the rotational power around a central axis of drive shaft 22 to rotational power around an axis substantially orthogonal to the central axis of drive shaft 22. Bevel gear 26 may be connected through drive shaft splines 28 or other means to a central drive shaft 30 extending at least partially through a rotating end cutter drum assembly 142 and rotating center cutter drum assembly 146. One or more additional drive shafts, such as drive shaft 32 running axially through the center of center cutter drum assembly 146, may also be connected directly or indirectly to bevel gear 26 to convert the rotational power from the one or more drive shafts 22 into rotation of the cutter drum assemblies.

One of ordinary skill in the art will recognize that the mining machine may include any number of cutter drum assemblies rotatably supported on gear and bearing housings connected to boom members 134 extending from body portion 120 of mining machine 100. The gear assemblies transferring rotational power from one or more input drive shafts 22 to one or more drive shafts connected to rotating cutter drum assemblies 142, 146 may also include additional gears arranged to produce desired output torques and rotational speeds. These additional gears may include planetary gear assemblies including a sun gear, planet gears engaged with the sun gear and rotatably supported on a planet carrier, and a ring gear engaged with the planet gears. The one or more drive shafts 30, 32 connected to rotating cutter drum assemblies 142, 146 may be rotatably supported by bearing assemblies mounted in the gear and bearing housings.

In accordance with various implementations of this disclosure, manifolds 132 may also be provided extending along boom members 134 and configured for conveying liquid from body portion 120 of mining machine 100 to cutter drum assemblies 142, 146 and cutting elements (not shown) secured to the rotating cutter drum assemblies 142, 146. Certain retrofit implementations may include providing these manifolds on an existing mining machine without liquid spraying capabilities by attaching the manifolds along the body and boom members through welding or other joining processes. The arrangement of the manifolds along the exterior of boom members 134 also facilitates access to the manifolds for any necessary repairs or maintenance. Spray devices carried by the cutting elements may direct a liquid spray from the cutting elements during rotation of the cutter drum assemblies. The manifolds may be positioned on the body portion of the mining machine, and extending along the boom members for supplying liquid to the cutting elements of the cutter drum assemblies. Liquid conveyed to the cutter drum assemblies through the manifolds extending along the boom members may be directed into stationary liquid passageways 138, 152 that extend through various portions 52, 122, 124 of the gear and bearing housing (see FIG. 7).

Stationary liquid passageways 138, 152 extending through the gear and bearing housing may be formed as bores or tubes extending through portions of the gear and bearing housing. Liquid provided from the manifolds 132 along boom members 134 may first enter one or more water dams 136 formed in the gear and bearing housing. The one or more water dams 136 may be configured as an annular reservoir or one or more separate reservoirs machined into an outer periphery of the stationary gear and bearing housing. One or more water dam covers 125 may be provided to seal off the water dam and contain water or other liquid received from manifolds 132. Liquid may then pass from the one or more water dams 136 into multiple stationary liquid passageways 138, 152 through portions of the gear and bearing housing.

Figure 8:
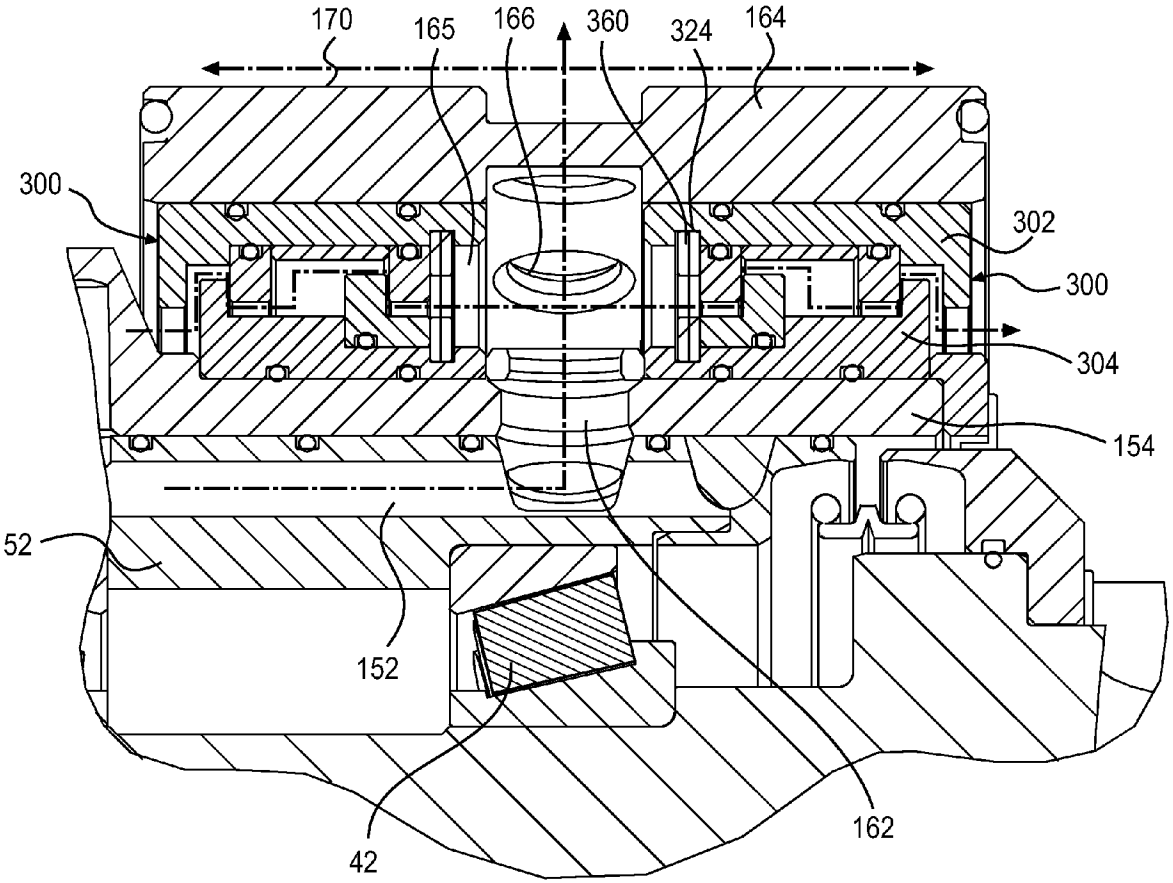
FIG. 8 is a cross-sectional view depicting a portion of the mining machine of FIG. 1.

As shown in FIG. 8, the liquid in stationary liquid passageway 152 may then pass through inner diffuser ring openings 162 in an inner diffuser ring 154 into an annular cavity 165 defined between two labyrinth seal assemblies 300. The labyrinth seal assemblies may be configured to include stationary seal rings that are fixed in position relative to the non-rotating gear and bearing housing, and seal rings that rotate with the cutter drum assemblies. In accordance with various implementations of this disclosure, labyrinth seal assemblies 300 may be non-contacting, floating seal assemblies configured such that the rotating portions of the seal assemblies do not contact or rub against the stationary portions of the seal assemblies, and are therefore not subject to wear or failure resulting from continued rubbing of the seal components during use. The seal assemblies are "floating" since the rotating and stationary portions of the seal assemblies have sufficient clearance between each other to allow for relative movement between the components of the seal assemblies during operation. Liquid pressure applied to the seal assemblies helps to maintain desired clearances between the components and allows the seal assemblies to self-adjust and center themselves relative to each other to account for variations in the machined dimensions of the gear and bearing housings and in the cutter drum assemblies.

Figure 9:
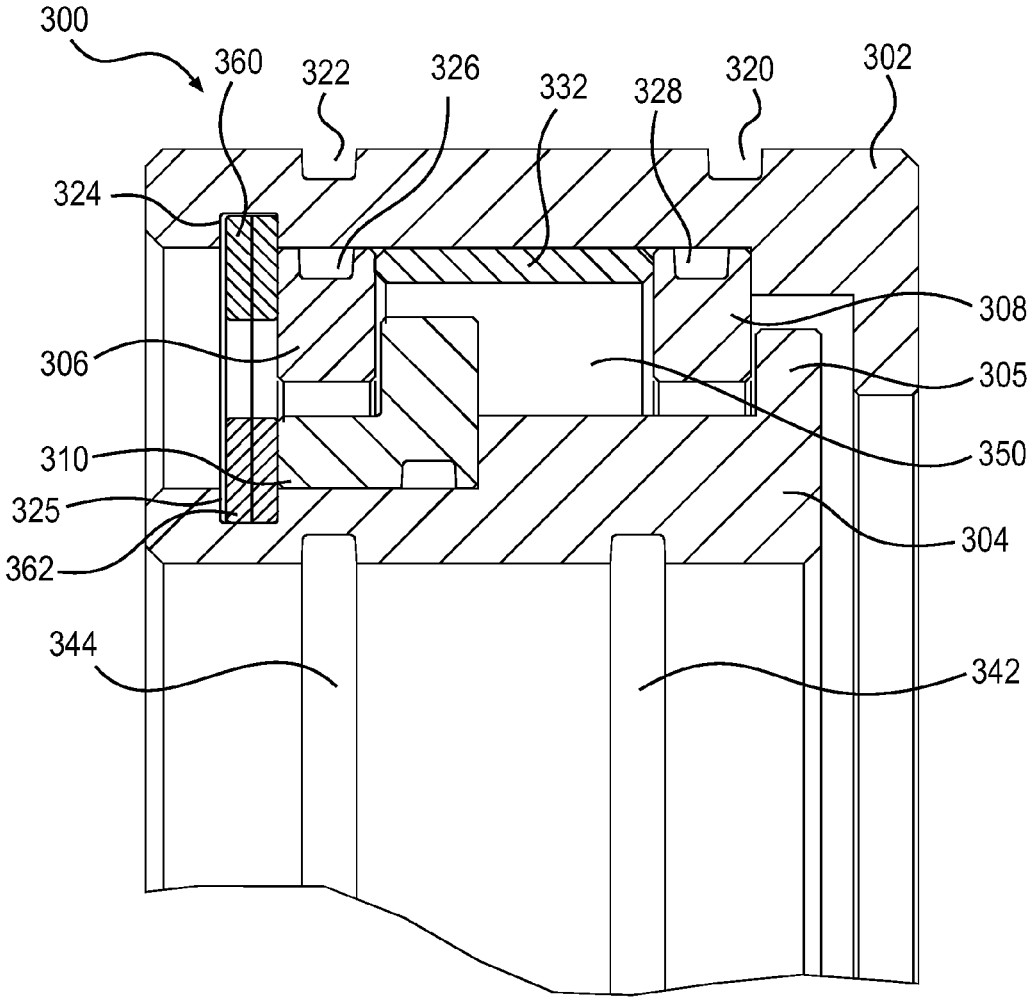
FIG. 9 is a cross-sectional view of an exemplary seal assembly from the mining machine of FIG. 1.

Labyrinth seal assemblies 300, shown in detail in FIGS. 8 and 9, may be provided around the outer circumference of portion 52 of the stationary gear and bearing housing and between the outside of this portion of the gear and bearing housing and the inside of the outer rotating shell of rotating center drum assembly 146. As shown at one end of center drum assembly 146 in FIG. 3, this arrangement makes labyrinth seal assemblies 300 readily accessible by removal of the outer shell of the cutter drum assembly without having to take apart the gear and bearing housing. Leakage from labyrinth seal assemblies 300 may also be diverted away from the gear and bearing assemblies in the gear and bearing housing and to the outside of the mining machine. As shown in FIG. 8, liquid passing into annular cavity 165 through inner diffuser ring openings 162 of inner diffuser ring 164 may then pass out of annular cavity 165 along paths through the labyrinth seal assemblies 300 and/or through outer diffuser ring openings 166 in an outer diffuser ring 164. Outer diffuser ring 164 is clamped between portions of the outer shell of rotating center cutter drum assembly 146 such that outer diffuser ring 164 rotates with the rotating center cutter drum assembly.

The outer diffuser ring openings 166 may be aligned with cutter element port group 180 in the outer shell of rotating center cutter drum assembly 146 (see FIG. 2). As the cutter drum assembly rotates, liquid passing into annular cavity 165 through inner diffuser ring openings 162 may have periodic straight flow paths out through outer diffuser ring openings 166 in outer diffuser ring 164. These periodic straight flow paths into cutter element ports of cutter element port group 180 occur when rotating outer diffuser ring openings 166 are in radial alignment with stationary inner diffuser ring openings 162. At these points the water flowing through annular cavity 165 experiences relatively less resistance to flow and resulting smaller pressure drop than when the inner and outer diffuser ring openings are not radially aligned. Rotation of center cutter drum assembly 146 therefore results in fluctuations in liquid pressure drop out through cutter element port group 180 radially outward from annular cavity 165 defined between labyrinth seal assemblies 300.

Figure 4:
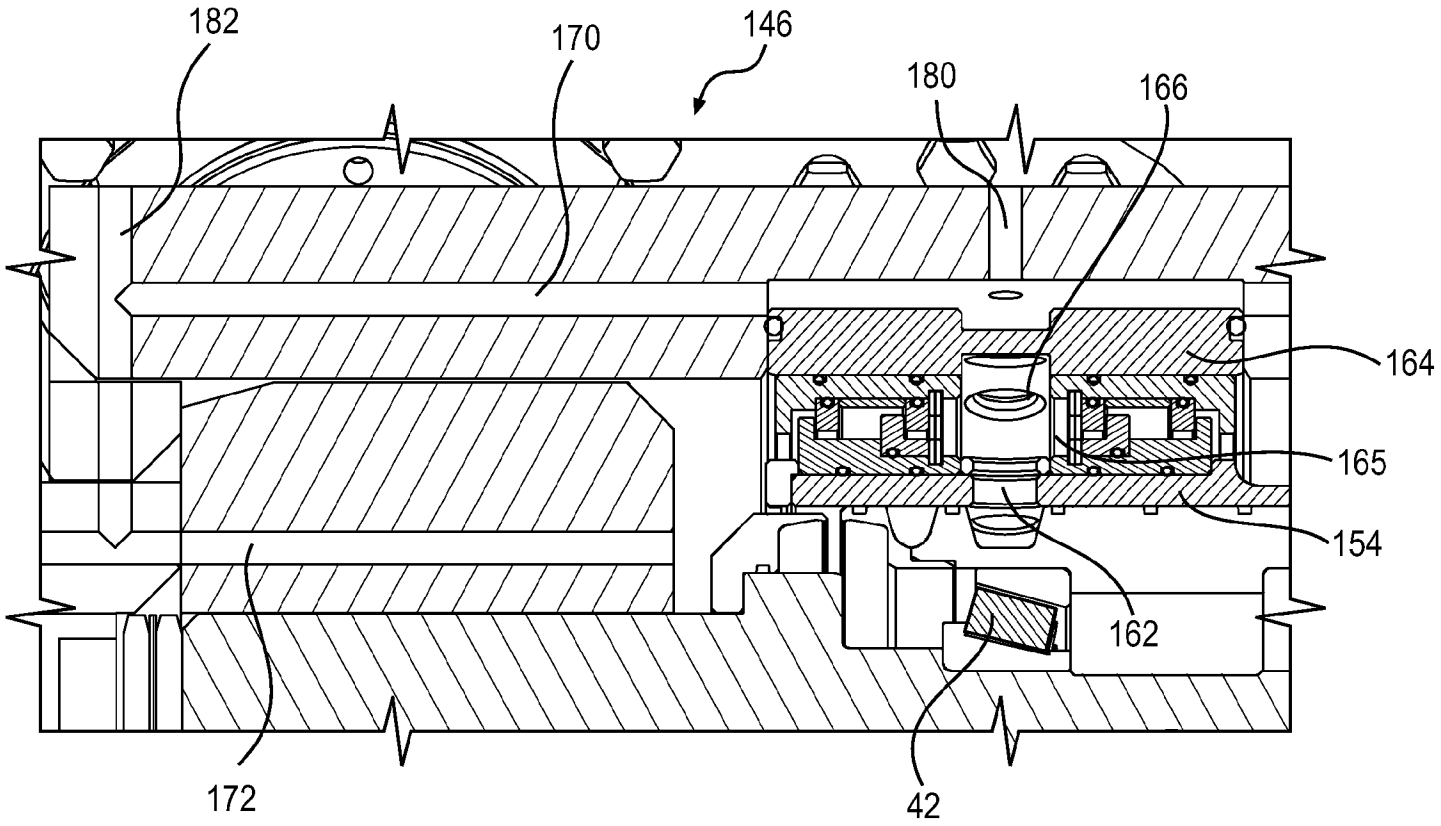
FIG. 4 is a cross-sectional view depicting a portion of the mining machine of FIG. 1.

As shown in FIG. 4, after having passed radially outward through outer diffuser ring openings 166 in outer diffuser ring 164, liquid may exit through cutter element port group 180 and spray nozzles (not shown) located on or in close proximity to cutter elements (not shown). Additionally, some of the liquid that has entered the annular cavity between the outer periphery of outer diffuser ring 164 and cutter element port group 180 may enter a rotatable primary liquid passageway 170 defined through a portion of rotating center cutter drum assembly 146. A "rotatable" liquid passageway as used throughout this disclosure refers to a liquid passageway formed in portions of the rotating cutter drum assemblies. The stationary liquid passageways are formed in portions of the stationary gear and bearing housing connected to boom members 134. Rotatable primary liquid passageway 170 distributes some of the liquid to another cutter element port group 182 axially spaced along the outer shell of rotating center cutter drum assembly 146 from port group 180. Any liquid not exiting cutter element port group 182 may be directed into a rotatable secondary liquid passageway 172. Additional liquid in annular cavity 165 defined between the two labyrinth seal assemblies 300 may leak in the direction of the center arrow shown in FIG. 8, through one of the labyrinth seal assemblies 300 and exiting through bleeder ports (not shown) in the rotating center cutter drum assembly.

Figure 6:
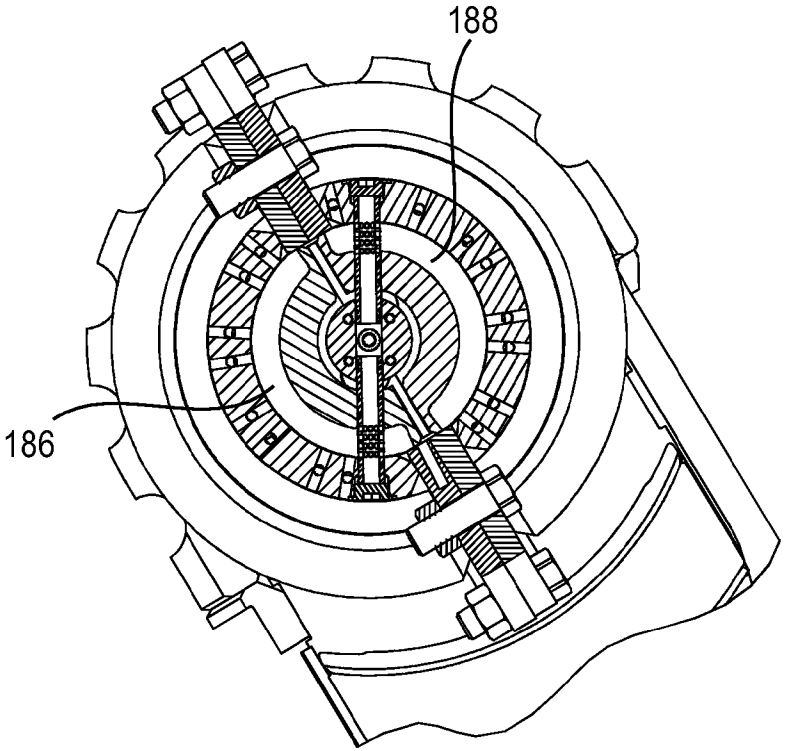
FIG. 6 is a radial cross-sectional view through a center portion of the mining machine of FIG. 1.
Figure 5:
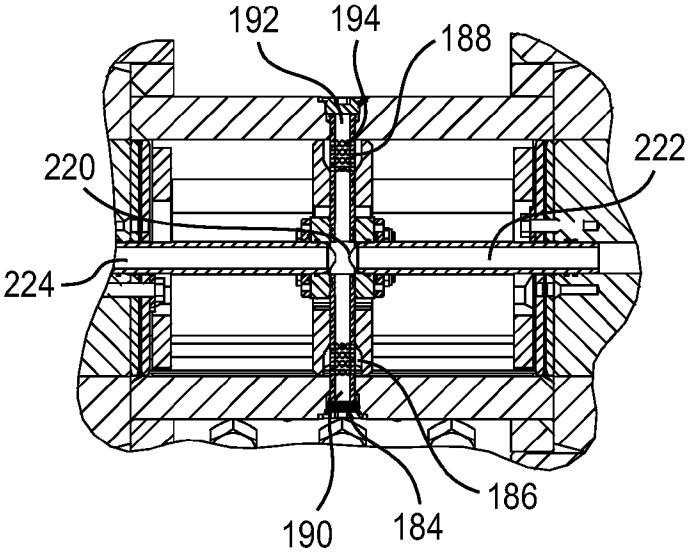
FIG. 5 is an axial cross-sectional view through a center portion of the mining machine of FIG. 1.

Liquid that does not exit through the spray nozzles for cutter elements at each of cutter element port groups 180, 182, 184 may then enter center ring liquid passageways 186, 188 defined in a center portion of the gear and bearing housing rotatably supporting center cutter drum assembly 146. The center ring liquid passageways may be defined to include an upper extent 188 and a lower extent 186, where the upper and lower extents may each define arcuate cavities extending over an arc that is less than or equal to 180 degrees. As seen in the axial and radial cross sectional views of FIGS. 5 and 6, liquid entering center ring liquid passageways 186, 188 may then enter through spigot openings 194 into ends of radially oriented spigots 190, 192 extending radially outward from a center manifold 220. Spigots 190, 192 may each extend radially outward through center ring liquid passageways 186, 188, and may rotate with center cutter drum assembly 146. As spigot openings 194 at end portions of each spigot 190, 192 pass through center ring liquid passageways 186, 188, liquid in the center ring liquid passageways 186, 188 enters the spigots through openings 194. Spigots 190, 192 direct the liquid into a center manifold 220, and from there the liquid may pass axially through manifold tubes 222, 224. Axially oriented manifold tubes 222, 224 lead from center manifold 220 at the center of center cutter drum assembly 146 in opposite axial directions to rotating end cutter drum assemblies 142 at both ends of center cutter drum assembly 146. Additional liquid passageways (not shown) may be provided in rotating end cutter drum assemblies 142 to direct liquid to additional cutter element port groups (not shown) on each of the rotating end cutter drum assemblies. Distribution of the proper amount of liquid to each of the cutter element port groups on rotating center cutter drum assembly 146 and rotating end cutter drum assemblies 142 may be a function of controlling the amount of liquid pressure drop at various portions of the liquid flow path leading from manifold 132 to the cutter element port groups.

Annular cavity 165 may be defined between labyrinth seal assemblies 300, and may be configured to control a pressure drop and resulting liquid back pressure in the flow path of the liquid by providing a controlled leakage path to the outside of the cutter drum assemblies. As illustrated in FIGS. 2, 3, and 8, liquid leaking through a labyrinth seal assembly 300 in a direction opposite from the direction of the center arrow in FIG. 8 may be directed to the outside of center cutter drum assembly 146 and safely away from the gear and bearing assemblies. As long as liquid is flowing in the flow path through annular cavity 165 defined by two labyrinth seal assemblies 300, some of the liquid may leak out through each of the labyrinth seal assemblies. This leakage may occur in the direction of the center arrow in FIG. 8 and out of bleeder ports in the rotating center cutter drum assembly, or opposite to the direction of the center arrow in FIG. 8 through additional leakage pathways to the outside of center cutter drum assembly 146. This is because the labyrinth seal assemblies are purposefully designed with axial and radial gaps between their stationary and rotating components. A significant benefit derived from this design is that the components of each labyrinth seal assembly will not wear out from rubbing contact between components that are moving relative to each other. The arrangement of the "floating" components that make up the labyrinth seal assemblies also allows seal assembly components that may be misaligned as a result of machining tolerances for components of the cutter drum assemblies to shift and self-adjust their relative positions when exposed to liquid pressure.

As shown in the detailed view of FIG. 9, labyrinth seal assembly 300 may include outer seal rings 306, 308, which are in fixed and sealed engagement with an outer seal assembly shell 302. Outer seal ring 306 may include an outer circumferential o-ring groove 326, and outer seal ring 308 may include an outer circumferential o-ring groove 328. Outer seal assembly shell 302 may be pressed into fixed and sealed engagement with outer diffuser ring 164. O-rings seated in outer circumferential o-ring grooves 320, 322 of outer seal assembly shell 302 may provide a seal against fluid leakage between outer diffuser ring 164 and outer seal assembly shell 302. As shown in FIGS. 2 and 8, o-rings may also be provided at both axial ends of outer diffuser ring 164, between outer diffuser ring 164 and rotating center cutter drum assembly 146. Outer diffuser ring 164 may also be pressed into fixed and sealed engagement with the rotating center cutter drum assembly 146. Outer seal rings 306, 308 and outer seal assembly shell 302 rotate with outer diffuser ring 164 and rotating center cutter drum assembly 146. A spacer 332 may be provided between outer seal rings 306, 308 of each labyrinth-type seal assembly 300 to maintain the outer seal rings at a desired spacing. An inner seal ring 310 may be seated against a recessed shoulder on inner seal assembly shell 304. O-rings may be provided in inner circumferential O-ring grooves 342, 344 of inner seal assembly shell 304 to provide a seal against fluid leakage between inner seal assembly shell 304 and inner diffuser ring 154. Additional O-rings may also be provided between inner diffuser ring 154 and portion 52 of the gear and bearing housing. Inner seal ring 310, inner seal assembly shell 304, and inner diffuser ring 154 all remain stationary relative to portion 52 of the stationary gear and bearing housing. Outer seal rings 306, 308, spacer 332, outer seal assembly shell 302, and outer diffuser ring 164 all rotate together with rotating center cutter drum assembly 146.

As shown in FIGS. 8 and 9, an outer snap ring 360 may be provided in outer snap ring groove 324 at one axial end of outer seal assembly shell 302. An inner snap ring 362 may be provided in inner snap ring groove 325 at the corresponding axial end of inner seal assembly shell 304. Outer and inner snap rings 360, 362 may be configured to hold outer seal rings 306, 308, spacer 332, and inner seal ring 310 in axially spaced relation to each other and to inner seal assembly shell 304 and outer seal assembly shell 302. The relative shapes, sizes, and spacings of the various components of labyrinth seal assemblies 300 may be selected to provide a tortuous leak path between the components and through cavity 350 of each seal assembly for some of the liquid in annular cavity 165, as illustrated by the center arrow in FIG. 8. The seal assemblies 300 may be designed to provide a desired pressure drop and quantity of liquid leakage that will result in the desired amount of liquid being provided to each of the cutter element port groups 180, 182, 184. Each of the cutter element port groups may include multiple ports spaced around the outer periphery of the rotating cutter drum assemblies. Each of the ports may include fluid couplings and physical interconnections with cutting elements and spray nozzles. Radial gaps between inner diameters of outer seal rings and either outer diameters of inner seal ring 310 or outer diameters of portions of inner seal assembly shell 304 may be selected in accordance with various design parameters. These design parameters may include, but are not limited to, a desired cross-sectional area for a liquid leakage flow path and pressure drop through the seal assemblies, the sizes and shapes of the various seal components calculated to provide sufficient strength for handling liquid pressures, and a radial gap sufficient to account for machining tolerances. In some implementations, machining tolerances may result in a certain amount of out-of-roundness of the cutter drum assemblies or other components. Radial gaps between the components may be designed to accommodate such variations. Axial gaps between the various components of the seal assemblies may also be selected in accordance with similar design parameters.

The labyrinth-type, non-contacting seal assemblies contained within the cutter drum assemblies direct liquid from stationary liquid passageways 138, 152 to rotatable primary and secondary liquid passageways 170, 172, and passageways leading to cutter element port group 182, while preventing leakage of liquid into contact with the gear or bearing assemblies. The seal assemblies are designed to provide controlled liquid leakage flow paths that divert some liquid leakage away from the bearing and gearing assemblies and externally out of the cutter drum assembly. Because the various components of the seal assemblies are configured to allow a controlled amount of leakage through the seal assemblies, while being axially and radially spaced from each other to avoid rubbing contact between components, the seal assemblies are not subject to failure resulting from wear over extended periods of use. The controlled leakage in combination with periodic fluctuations in pressure drop through the seal assemblies as inner diffuser ring openings 162 move into and out of radial alignment with outer diffuser ring openings 166 may be configured to achieve the desired amount of liquid flow and liquid pressure to all the ports and cutting elements included in cutter element port groups 180, 182, 184.

Methods of applying various exemplary implementations of a continuous mining machine designed in accordance with the parameters discussed above will be discussed in more detail in the following section in order to further illustrate the disclosed concepts.

INDUSTRIAL APPLICABILITY

The disclosed continuous mining machine may provide an apparatus and method for spraying a mine face with liquid during a mining operation that includes supplying liquid from a stationary source on continuous mining machine 100 to rotatable cutting elements mounted on one or more rotatable cutter drum assemblies 142, 146 of the machine. The method may include directing the liquid through manifold 132 extending along stationary boom members 134 of the machine, into water dam 136 formed in a stationary gear and bearing housing connected to the boom assembly of the machine, along stationary liquid passageways 138, 152 formed in the gear and bearing housing, and into annular liquid cavity 165 defined between two labyrinth-type, non-contacting seal assemblies 300. The method may further include providing a controlled amount of liquid leakage through each of the labyrinth-type, non-contacting seal assemblies away from the gear and bearing housing and to the outside of continuous mining machine 100. The labyrinth-type, non-contacting seal assemblies may provide a means for controlling the amount of liquid and the liquid pressure in passageways leading to cutter drum port groups interspersed along the outer periphery of the rotating cutter drum assemblies. Flow paths through the labyrinth seal assemblies may be designed to provide controlled leakage pathways to rotatable liquid passageways formed in the cutter drum assemblies that lead to cutter drum port groups. The labyrinth seal assemblies may also define leakage pathways leading away from the gear and bearing assemblies to the outside of the continuous mining machine.

The provision of external manifolds along the stationary boom assembly of the mining machine may also provide a way to retrofit an existing continuous mining machine to include liquid flow paths for directing liquid to the cutting elements provided around the outer periphery of the cutter drum assemblies. The externally mounted manifolds are accessible for any necessary maintenance or repair. Liquid passing through the manifolds along the boom assemblies may then enter one or more liquid reservoirs such as water dam 136 formed in the gear and bearing housing connected to ends of the boom assemblies and configured to rotatably support the cutter drum assemblies. The one or more liquid reservoirs formed in the gear and bearing housing may provide a well from which the liquid may be supplied through stationary liquid passageways through the gear and bearing housing. The presence of this well of liquid in the gear and bearing housing may help to ensure that sufficient liquid is available for supply to the cutting elements during use of the mining machine, even when fluctuations in the quantity or pressure of the liquid being supplied from the body portion of the continuous mining machine are experienced.

Labyrinth-type, non-contacting seal assemblies 300 also provide a way to control leakage of liquid from the flow path for the liquid between stationary liquid passageways in the gear and bearing housing and rotatable liquid passageways through the rotating cutter drum assemblies. Rather than providing a positive pressure liquid seal as is traditionally used between the stationary and rotating portions of the continuous mining machine, the labyrinth-type seal assemblies may be designed purposefully to provide a controlled leakage pathway for a portion of the liquid being supplied to the cutting elements. As a result of the stationary and rotating components of the seal assemblies not actually being in contact with each other, the labyrinth seal assemblies are not subject to the wear and potential wear-induced failures of traditional positive pressure seals. The spacing between the components of the seal assemblies, and their resulting ability to "float" relative to each other, also allows the seal assemblies to self-adjust their relative positions when exposed to liquid pressure, and to compensate for variations in machining tolerances of components in the cutter drum assemblies.

The desired pressure drop through the annular cavity defined between two labyrinth seal assemblies may be predetermined and pre-set as a function of a desired amount and pressure of liquid being supplied to the various cutter drum port groups along the outer periphery of the rotating cutter drum assemblies. The provision of a stationary diffuser ring at the entrance to the annular cavity, with circumferentially-spaced openings through which the liquid enters the annular cavity, and a corresponding rotating outer diffuser ring with circumferentially-spaced openings through which the liquid exits the annular cavity, may also result in desired fluctuations in the liquid pressure. The flow path for liquid through the seal assemblies may be a relatively unobstructed, substantially straight flow path when the inner diffuser ring openings are radially aligned with the outer diffuser ring openings. As the cutter drum assembly rotates, the circumferentially-spaced openings through the outer diffuser ring move out of radial alignment with the openings through the inner diffuser ring, thereby increasing the resistance to flow of liquid through the annular cavity. The resulting fluctuations in liquid pressure during rotation of the cutter drum assemblies may help to ensure a desired distribution of liquid to the various cutter drum port groups. As discussed above, the shapes, sizes, and spacings between the various components of the seal assemblies may also be chosen to provide a pre-set amount of pressure drop for the liquid passing through the seal assemblies. As one non-limiting example, greater axial and/or radial spacings between the seal rings of the seal assemblies may allow more liquid leakage from the annular cavity to the outside of the mining machine. This exemplary implementation may be desirable when the quantity or pressure of liquid being supplied through the manifolds to the rotating cutter drum assemblies must be reduced before being supplied to the cutter drum port groups and cutting elements. In an alternative exemplary implementation where the axial and/or radial spacings between various components of the seal assemblies are made smaller, the leakage of liquid through the seal assemblies may be reduced and a greater amount or pressure of liquid may be supplied to the cutter drum port groups.

It will be apparent to those skilled in the art that various modifications and variations can be made to the disclosed continuous mining machine. As one non-limiting example, the stationary liquid passageways through the gear and bearing housing, and the rotatable liquid passageways through the rotating cutter drum assemblies, may be defined as different shaped bores, annular passageways, or other configurations that provide liquid from stationary portions of the machine to rotating portions and the rotating cutting elements. The number and configuration of the labyrinth-type, non-contacting seal assemblies may also be varied in accordance with different performance parameters. The seal assemblies may be pre-assembled and then installed onto the cutter drum assemblies, or may be installed onto the cutter drum assemblies piece by piece. Other implementation will be apparent to those skilled in the art from consideration of the specification and practice of the disclosed methods. It is intended that the specification and examples be considered as exemplary only, with a true scope being indicated by the following claims and their equivalents.

What is claimed is:

1. A continuous mining machine, comprising:

a stationary boom member;

a stationary gear and bearing housing attached to the stationary boom member;

a cutter drum assembly rotatably mounted on the stationary gear and bearing housing;

cutting elements mounted on the rotatable cutter drum assembly, with spray nozzles mounted on or in close proximity to the cutting elements, the spray nozzles configured to direct liquid spray at a mine face as mine material is dislodged by rotation of the cutter drum assembly and contact of the cutting elements with the mine face;

stationary liquid passageways provided through the gear and bearing housing;

rotatable liquid passageways provided through the rotatable cutter drum assembly and configured to convey liquid to the spray nozzles;

a liquid distribution cavity defined within the cutter drum assembly between two labyrinth-type, non-contacting seal assemblies, the liquid distribution cavity configured to convey liquid from the stationary liquid passageways to the rotatable liquid passageways and to the spray nozzles; and the two labyrinth-type, non-contacting seal assemblies configured to control at least one of liquid quantity and liquid pressure in the stationary and rotatable liquid passageways by providing a controlled leakage pathway configured for directing a portion of the liquid away from the stationary gear and bearing housing to outside of the continuous mining machine.

2. The continuous mining machine of claim 1, wherein the two labyrinth-type, non-contacting seal assemblies are further configured with spacing between components of the seal assemblies selected to allow the components to self-adjust their relative positions when exposed to liquid pressure, and to compensate for variations in machining tolerances of components in the cutter drum assembly.

3. The continuous mining machine of claim 1, further including an inner diffuser ring at an entrance to the liquid distribution cavity and an outer diffuser ring at an exit from the liquid distribution cavity, the inner diffuser ring being connected to the stationary gear and bearing housing, and the outer diffuser ring being connected to the rotatable cutter drum assembly.

4. The continuous mining machine of claim 3, wherein the inner diffuser ring includes a plurality of circumferentially-spaced openings therethrough, and the outer diffuser ring includes a plurality of circumferentially-spaced openings therethrough, and wherein the openings through the inner diffuser ring are periodically aligned with the openings through the outer diffuser ring during rotation of the rotatable cutter drum assembly.

5. The continuous mining machine of claim 1, further including a manifold extending along an outside of the stationary boom member and configured to carry liquid from a main body portion of the machine to the stationary liquid passageways provided through the gear and bearing housing.

6. The continuous mining machine of claim 1, wherein the stationary liquid passageways include a reservoir configured for accumulating a quantity of liquid before the liquid passes on to the liquid distribution cavity.

7. The continuous mining machine of claim 1, wherein the labyrinth-type, non-contacting seal assemblies each include an inner stationary shell, at least one inner stationary seal ring in fixed and sealed engagement with the inner stationary shell, an outer rotating shell, and at least one outer rotating seal ring in fixed and sealed engagement with the outer rotating shell.

8. The continuous mining machine of claim 7, wherein the at least one inner stationary seal ring and the at least one outer rotating seal ring are positioned in spaced relationship to each other to provide at least a portion of the controlled leakage pathway.

9. The continuous mining machine of claim 7, wherein the controlled leakage pathway is at least partially defined by one or more of the relative shapes, sizes, and spacings between two or more of the inner stationary shell, the at least one inner stationary seal ring, the outer rotating shell, and the at least one outer rotating seal ring.

10. The continuous mining machine of claim 7, further including two spaced outer rotating seal rings maintained in spaced relationship from each other by an interposed spacer.

11. The continuous mining machine of claim 1, wherein:

the rotatable liquid passageways include axially oriented and radially oriented liquid passageways;

the stationary liquid passageways through the gear and bearing housing include arcuate center ring cavities, the arcuate center ring cavities being configured to receive liquid from the rotatable axially oriented liquid passageways; and the radially oriented rotatable liquid passageways include radially oriented spigots configured to convey liquid from the rotatable axially oriented liquid passageways to a center manifold located approximately at a center of the rotatable cutter drum assembly, the spigots being configured to rotate with the rotatable cutter drum assembly and pass through the arcuate center ring cavities.

12. A method of controlling at least one of a quantity and a pressure of liquid supplied from a stationary source on a body portion of a continuous mining machine to rotatable cutting elements mounted on a rotatable cutter drum assembly of the machine; the method comprising:

directing the liquid through a manifold extending along a stationary boom member of the machine, into a liquid reservoir formed in a stationary gear and bearing housing mounted on the boom member of the machine;

directing the liquid from the reservoir along stationary liquid passageways formed in the gear and bearing housing, and into a liquid distribution cavity defined between two labyrinth-type, non-contacting seal assemblies; and providing a controlled amount of liquid leakage through at least one of the labyrinth-type, non-contacting seal assemblies away from the gear and bearing housing and to the outside of the continuous mining machine.

13. The method of claim 12, further including:

directing liquid from the liquid distribution cavity into rotatable liquid passageways defined in the rotatable cutter drum assembly; and directing liquid from the rotatable liquid passageways into ports leading to the cutting elements mounted on the rotatable cutter drum assembly.

14. The method of claim 12, further including directing liquid into the liquid distribution cavity through stationary openings in a stationary inner diffuser ring and out of the liquid distribution cavity through rotating openings in a rotating outer diffuser ring, such that liquid pressure in the liquid distribution cavity fluctuates as the stationary openings are periodically radially aligned with and then out of alignment with the rotating openings in the outer diffuser ring.

15. The method of claim 12, wherein providing a controlled amount of liquid leakage through at least one of the labyrinth-type, non-contacting seal assemblies includes providing a stationary seal ring of the at least one labyrinth-type, non-contacting seal assembly in spaced relation to a rotatable seal ring of the at least one labyrinth-type, non-contacting seal assembly such that the stationary and rotatable seal rings do not contact each other.

16. The method of claim 12, wherein providing a controlled amount of liquid leakage through at least one of the labyrinth-type, non-contacting seal assemblies includes providing stationary and rotatable sealing components of the at least one labyrinth-type, non-contacting seal assembly with one or more of relative shapes, sizes, and spacings to achieve at least one of a desired quantity and pressure drop of the liquid leakage.

17. The method of claim 16, further including providing stationary and rotatable sealing components of the at least one labyrinth-type, non-contacting seal assemblies with suitable spacings such that liquid pressure provided to the liquid distribution cavity results in the stationary and rotatable sealing components self-adjusting their relative positions to remain in non-contacting relationship to each other.

18. The method of claim 12, further including directing liquid from the liquid distribution cavity into rotatable liquid passageways defined in the rotatable cutter drum assembly, the rotatable liquid passageways including axially oriented and radially oriented liquid passageways.

19. The method of claim 18, wherein:

the stationary liquid passageways through the gear and bearing housing include arcuate center ring cavities, the arcuate center ring cavities receiving liquid from the rotatable axially oriented liquid passageways; and radially oriented spigots of the radially oriented rotatable liquid passageways conveying liquid from the rotatable axially oriented liquid passageways to a center manifold located approximately at a center of the rotatable cutter drum assembly.

20. A continuous mining machine, comprising:

a stationary boom member;

a stationary gear and bearing housing attached to the stationary boom member;

a cutter drum assembly rotatably mounted on the stationary gear and bearing housing;

cutting elements mounted on the rotatable cutter drum assembly, with spray nozzles mounted on or in close proximity to the cutting elements, the spray nozzles configured to direct liquid spray at a mine face as mine material is dislodged by rotation of the cutter drum assembly and contact of the cutting elements with the mine face;

at least one stationary liquid passageway provided through the gear and bearing housing;

at least one rotatable liquid passageway provided through the rotatable cutter drum assembly and configured to convey liquid to the spray nozzles;

a liquid distribution cavity defined within the cutter drum assembly between two labyrinth-type, non-contacting seal assemblies, the liquid distribution cavity configured to convey liquid from the at least one stationary liquid passageway to the at least one rotatable liquid passageway and to the spray nozzles;

the two labyrinth-type, non-contacting seal assemblies configured to control at least one of liquid quantity and liquid pressure in the at least one stationary and rotatable liquid passageways by providing a controlled leakage pathway configured for directing a portion of the liquid away from the stationary gear and bearing housing to outside of the continuous mining machine, and by providing a controlled leakage pathway configured for directing a portion of the liquid from the liquid distribution cavity into the at least one rotatable liquid passageway; and an inner diffuser ring positioned at an entrance to the liquid distribution cavity and an outer diffuser ring positioned at an exit from the liquid distribution cavity, the inner diffuser ring being connected to the stationary gear and bearing housing, and the outer diffuser ring being connected to the rotatable cutter drum assembly, wherein the inner diffuser ring includes a plurality of circumferentially-spaced openings therethrough, and the outer diffuser ring includes a plurality of circumferentially-spaced openings therethrough, and wherein the openings through the inner diffuser ring are periodically aligned with the openings through the outer diffuser ring during rotation of the rotatable cutter drum assembly.

* * * * *